US008469243B2

(12) United States Patent
Mizobe et al.

(10) Patent No.: US 8,469,243 B2
(45) Date of Patent: Jun. 25, 2013

(54) MOLTEN METAL DISCHARGE NOZZLE

(75) Inventors: Arito Mizobe, Fukuoka (JP); Hideaki Kawabe, Fukuoka (JP); Manabu Kimura, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 422 days.

(21) Appl. No.: 12/816,713

(22) Filed: Jun. 16, 2010

(65) Prior Publication Data

US 2011/0017784 A1 Jan. 27, 2011

(30) Foreign Application Priority Data

Jul. 24, 2009 (JP) ..... 2009-172805

(51) Int. Cl.
*B67D 3/00* (2006.01)

(52) U.S. Cl.
USPC ..... 222/591; 222/594; 222/595; 266/195; 266/236; 164/495

(58) Field of Classification Search
USPC .... 222/591, 594, 595; 266/195, 236; 164/495
See application file for complete search history.

(56) References Cited

U.S. PATENT DOCUMENTS 3,797,712 A * 3/1974 Kutzer et al. ..... 222/591
8,240,524 B2 * 8/2012 Mizobe et al. ..... 222/591

FOREIGN PATENT DOCUMENTS

JP 11156501 A 6/1999
JP 2002066699 A 3/2002
JP 2002096145 A 4/2002
JP 2007090423 A 4/2007

* cited by examiner

*Primary Examiner* — Lois Zheng
(74) *Attorney, Agent, or Firm* — Marty Fleit; Paul D. Bianco; Fleit Gibbons Gutman Bongini Bianco PL

(57) ABSTRACT

Provided is a molten metal discharge nozzle capable of suppressing turbulence in a molten metal stream passing through an inner bore thereof, with a simple structure. A cross-sectional shape of a wall surface of the inner bore, taken along an axis of the inner bore, comprises a part or an entirety of a curved line expressed by the following formula: $\log(r(z))=(1/n)\times\log((Hc+L)/(Hc+z))+\log(r(L))$ (1), where: $6\geqq n\geqq 1.5$; L is a length of the nozzle; Hc is a calculative hydrostatic head; and r(z) is a radius of the inner bore at a position located a distance z downward from an upper end of the nozzle, wherein, in a graph where the distance z is plotted with respect to a horizontal axis (X-axis) thereof, and a pressure of molten metal at a center of the inner bore in horizontal cross-section at a position located the distance z is plotted with respect to a vertical axis (Y-axis) thereof, an approximation formula of a line on the graph is established without simultaneously including two or more coefficients having opposite signs, and wherein, on an assumption that the line is derived from an approximation formula based on a linear regression, an absolute value of a correlation coefficient of the line is 0.95 or more.

1 Claim, 14 Drawing Sheets

FIG. 9

Table 1

| | | | Comparative sample 1 | Comparative sample 2 | Comparative sample 3 | Comparative sample 4 | Inventive sample 1 | Inventive sample 2 | Inventive sample 3 | Inventive sample 4 | Inventive sample 5 | Inventive sample 6 | Inventive sample 5 | Inventive sample 7 | Inventive sample 8 |
|---|---|---|---|---|---|---|---|---|---|---|---|---|---|---|---|
| Inner bore configuration | r(0) | *1 | 7.5 | 22.5 | 22.5 | 22.5 | 22.5 | 22.5 | 15 | 18.8 | 22.5 | 22.5 | 22.5 | 40 | 50 |
| | r(L) | *1 | 7.5 | 7.5 | 7.5 | 7.5 | 7.5 | 7.5 | 7.5 | 7.5 | 7.5 | 7.5 | 7.5 | 20 | 20 |
| | r(0)/r(L) | *1 | 1 | 3 | 3 | 3 | 3 | 3 | 2 | 2.5 | 3 | 3 | 3 | 2 | 2.5 |
| | n | *1 | – (straight) | (taper) | (R=47) | 1 | 1.5 | 2 | 4 | 4 | 4 | 6 | 7 | 4 | 4 |
| | Hc | *1 | – | – | – | 60.0 | 28.6 | 15.0 | 8.0 | 3.2 | 1.5 | 0.2 | 0.1 | 53.3 | 21.0 |
| | L (mm) | *1 | 120 | 120 | 120 | 120 | 120 | 120 | 120 | 120 | 120 | 120 | 120 | 300 | 300 |
| Relationship between distance z and pressure | Shape of line | *2 | inflection | inflection | inflection | inflection | arc | arc | straight | straight | straight | straight | inflection | straight | straight |
| | Correlation coefficient of linear | *2-1 | – | – | – | – | -0.95 | -0.97 | -0.99 | -0.99 | -0.99 | -0.99 | – | -0.99 | -0.99 |
| | Evaluation of line | *2-2 | × | × | × | × | ○ | ○ | ○ | ○ | ○ | ○ | × | ○ | ○ |
| | FIG. | *2 | FIG. 7 A | FIG. 7 B | FIG. 7 C | FIG. 7 D | FIG. 7 E | FIG. 7 F | FIG. 7 G | FIG. 7 H | FIG. 7 I | FIG. 7 J | FIG. 7 K | FIG. 7 L | FIG. 7 M |
| Scattering test | Visual evaluation | *3 | × | – | – | × | ○ | ○ | – | – | ○ | ○ | × | – | ○ |

*1: Parameters in the formulas 1 and 2
*2: A line on a z-pressure graph based on a simulation
2-1: A correlation coefficient (truncated to three decimal places) when an approximation formula is derived based on a linear regression for the line on the z-pressure graph
2-2: Evaluation on a shape of the line on the z-pressure graph ○ = good (shape for a stable stream without turbulence) × = bad (shape for a stream having turbu
*3: A scattering state at a lower end of a nozzle in a water test (result of visual relative observation) ○ = scattering: insignificant to non × = scattering: large to significant

FIG. 10

Table 2

| | | | Comparative sample 6 | Comparative sample 7 | Inventive sample 9 | Inventive sample 10 |
|---|---|---|---|---|---|---|
| Inner bore configuration | r(0) | *1 | 70 | 37 | 51 | 70 |
| | r(L) | *1 | 35 | 35 | 35 | 35 |
| | r(0)/r(L) | *1 | 2 | 1.1 | 1.5 | 2 |
| | n | *1 | – (taper) | 4 | 4 | 4 |
| | Hc | *1 | – | 924.0 | 49.3 | 15.3 |
| | L (mm) | *1 | 230 | 230 | 230 | 230 |
| Relationship between distance z and pressure | Shape of line | *2 | inflection | inflection | straight | straight |
| | Correlation coefficient of linear | *2-1 | – | – | -0.99 | -0.99 |
| | Evaluation of line | *2-2 | × | × | ○ | ○ |
| | FIG. | *2 | FIG. 8 A | FIG. 8 B | FIG. 8 C | FIG. 8 D |
| Actual operati | Thickness of adhered layer | (*4 | 20 | — | — | 0 (non) |

*1: Parameters in the formulas 1 and 2 (wherein a position of the lower end of L is an upper end surface of a lower plate of a sliding nozzle device)
*2: A line on a z-pressure graph based on a simulation
2-1: A correlation coefficient (truncated to three decimal places) when an formula is derived based on a linear regression for the line on the z-pressure graphapproximation
2-2: Evaluation on a shape of the line on the z-pressure graph ○ = good (shape for a stable stream without turbu
*4: An average thickness of an alumina-based layer adhered on a well surface of the inner bore during an actual casting operation

MOLTEN METAL DISCHARGE NOZZLE

FIELD OF THE INVENTION

The present invention relates to a molten metal discharge nozzle (hereinafter referred to simply as "nozzle") formed with an inner bore for allowing passage of molten metal and designed to be installed to a bottom of a molten metal vessel so as to discharge molten metal from the molten metal vessel through the inner bore, and more particularly to a configuration of the inner bore of the nozzle.

BACKGROUND ART

A nozzle to be installed to a bottom of a molten metal vessel is adapted to discharge molten metal in an approximately vertical direction through an inner bore thereof, by using a hydrostatic head (hydrostatic height) of molten metal as motive energy. The inner bore of the nozzle is typically formed in a straight configuration where it extends straight and vertically, a configuration where a corner edge thereof on the side of an upper end of the nozzle is formed in an arc shape, or a taper configuration where it taperedly extends from the upper end to a lower end of the nozzle.

The nozzle includes a type having not only a function of simply discharging molten metal but also a function of controlling a discharge volume (discharge rate) and a discharge direction of the molten metal. For example, as for a continuous casting nozzle to be installed to a bottom of a molten steel vessel such as a tundish, an upper nozzle 1*a* has a flow-volume control device (e.g., a sliding nozzle (SN) device; see the reference numeral 12 in FIG. 4) on a lower side thereof, as shown in FIG. 4. The nozzle also includes an open type (open nozzle) 1*b* devoid of the flow-volume control device, as shown in FIG. 5.

It is known that, if turbulence occurs in a molten metal stream passing through the inner bore of the conventional nozzle, it will cause various problems, regardless of the presence or absence of the flow-volume control device. For example, the turbulence is liable to disturb flow-volume control in the nozzle having the flow-volume control device, or to cause scattering of a molten metal stream discharged from a lower end of the open nozzle to an open environment (see the reference numeral 15 in FIG. 5).

A factor causing turbulence in a molten metal stream passing through the inner bore includes an adhesion of molten metal-derived non-metal inclusions, etc. (hereinafter referred to simply as "inclusion adhesion"), onto the inner bore (see the reference numeral 14 in FIG. 4), and a change in configuration of the inner bore due to uneven wear of the inner bore.

In order to avoid the above phenomena, various measures have heretofore been attempted. For example, as measures for the inclusion adhesion, the following Patent Document 1 proposes to inject gas from a wall surface of an inner bore of a nozzle. Further, the following Patent Document 2 proposes to form a refractory layer resistant to the inclusion adhesion (adhesion-resistant refractory layer), on a wall surface of an inner bore of a nozzle. The technique of injecting gas from a wall surface of an inner bore of a nozzle and the technique of forming an adhesion-resistant refractory layer on a wall surface of an inner bore of a nozzle have been implemented in all nozzles to be communicated with a molten metal discharge opening, such as an upper nozzle, and a sliding nozzle device and an immersion nozzle to be provided beneath the upper nozzle, and it has been verified that the techniques have a certain level of inclusion adhesion-prevention effect. However, a position, a shape, a speed, etc., of the inclusion adhesion, often vary due to a difference in casting conditions between individual casting operations or a fluctuation in casting conditions in the same casting operation, so that it is difficult to fully prevent the occurrence of the inclusion adhesion. Moreover, it is necessary to provide a complicated structure for the gas injection, and/or the adhesion-resistant refractory layer, in each of a plurality of nozzle regions when a nozzle is formed in an integral structure (a single-piece nozzle extending in an upward-downward direction), or in each of a plurality of nozzles when they are formed in a divided structure (comprising an upper nozzle and an immersion nozzle aligned in an upward-downward direction). This leads to complexity in nozzle production process, and complexity in casting operation and management, which causes an increase in cost.

As measures for the scattering of molten metal discharged from the lower end of the open nozzle, the following Patent Document 3 proposes to form an inner bore to have a step portion with a specific shape, and the following Patent Document 4 proposes to form an inner bore to have a taper portion. Although each of the open nozzles disclosed in the Patent Documents 3, 4 has a certain level of effect in an initial stage of a casting operation under some specific casting conditions, it is not sufficient measures for the scattering, because there are problems that a difference in level of the effect occurs due to a difference or fluctuation in casting conditions, and the effect will become smaller along with an increase in elapsed time of the casting operation.

PRIOR ART DOCUMENT

Patent Document

[Patent Document 1] JP 2007-90423A
[Patent Document 2] JP 2002-96145A
[Patent Document 3] JP 11-156501A
[Patent Document 4] JP 2002-66699A

SUMMARY OF THE INVENTION

Problem to be Solved by the Invention

It is an object of the present invention to provide a nozzle capable of suppressing turbulence in a molten metal stream passing through an inner bore thereof, with a simple structure.

More specifically, it is an object of the present invention to provide a nozzle capable of stabilizing turbulence in a molten metal stream passing through an inner bore thereof, while suppressing inclusion adhesion on a wall surface of the inner bore, wear of the wall surface of the inner bore, and scattering of molten steel discharged from a lower end of an open nozzle.

Means for Solving the Problem

The present invention provides a molten metal discharge nozzle formed with an inner bore for allowing passage of molten metal and designed to be installed to a bottom of a molten metal vessel so as to discharge molten metal from the molten metal vessel through the inner bore. In the molten metal discharge nozzle, a cross-sectional shape of a wall surface of the inner bore, taken along an axis of the inner bore, comprises a part or an entirety of a curved line expressed by the following formula (1): $\log(r(z))=(1/n)\times\log((Hc+L)/(Hc+z))+\log(r(L))$ (1), where: $6\geqq n\geqq 1.5$; L is a length of the nozzle; Hc is a calculative hydrostatic head; and r(z) is a radius of the inner bore at a position located a distance z downward from an upper end of the nozzle, wherein the calculative hydrostatic head Hc is expressed by the following formula (2): $Hc=((r(L)/r(0))^n \times L)/(1-(r(L)/r(0))^n)$ (2), where: $6 \geqq n \geqq 1.5$; r(0) is a radius of the inner bore at the upper end of the nozzle; and r(L) is a radius of the inner bore at a lower end of the nozzle. Further, in a graph where the distance z is plotted with respect to a horizontal axis (X-axis) thereof, and a pressure of molten metal at a center of the inner bore in horizontal cross-section at a position located the distance z is plotted with respect to a vertical axis (Y-axis) thereof, an approximation formula of a line on the graph is established without simultaneously including two or more coefficients having opposite signs, wherein, on an assumption that the line is derived from an approximation formula based on a linear regression, an absolute value of a correlation coefficient of the line is 0.95 or more.

The present invention will be specifically described below by taking, as an example, a nozzle (continuous casting nozzle) to be installed to a molten steel discharge opening of a bottom of a tundish which is a molten steel vessel as one type of molten metal vessel.

The inventors found out that turbulence in a molten steel stream passing through an inner bore of a nozzle is caused by turbulence in pressure distribution of molten steel in the inner bore.

Based on general fluid theories, a molten steel stream flowing from a tundish through an inner bore of a nozzle, and a pressure, etc., within the inner bore, are considered to be dependent on a depth (actual hydrostatic head (height)) Hm (see FIG. 1) of a molten steel bath (hereinafter referred to simply as "Hm", on a case-by-case basis). In this case, the Hm is constant, because a volume of molten steel in the tundish is kept approximately constant during a casting operation. Thus, in theory, a pressure of molten steel to be discharged from the nozzle is dependent on the constant Hm, so that it is to be in a constant or stable state.

However, from a simulation result, and an analysis result on a nozzle subjected to an actual casting operation, it was proven that, in actual casting operations, a molten steel pressure within an inner bore of a nozzle during discharge of molten steel from the nozzle is largely changed in the vicinity of the upper end of the nozzle, and the pressure change triggers the occurrence of turbulence in a molten steel stream.

This phenomenon can be schematically illustrated as shown in FIG. 2. In FIG. 2, the line 9 indicates an ideal pressure distribution with respect to a distance downward from a top surface of molten steel. However, in reality, as indicated by the line 8 in FIG. 2, the pressure is largely changed in the vicinity of the upper end of the nozzle.

It was proven that the cause of the phenomenon is as follows. A molten steel stream is not formed to flow uniformly and directly from a wide region of a molten steel bath including a molten steel surface within the tundish, toward an upper end of the inner bore of the nozzle, but to flow multidirectionally from the vicinities of the bottom surface of the tundish adjacent to the upper end of the inner bore of the nozzle, which is the inlet of the molten steel discharge passage, toward the inner bore. In addition, a flow speed of each of the multidirectional sub-streams is relatively high, and collision occurs between the multidirectional and high-speed sub-streams. Thus, as for a flow speed and a pressure of molten steel within the inner bore serving as the molten steel discharge passage, it is necessary to take into account the sub-streams flowing from the vicinity of the bottom surface of the tundish toward the upper end of the inner bore.

It was also proven that the formation of the sub-streams flowing from the vicinity of the bottom surface of the tundish toward the upper end of the inner bore, and a phenomenon such as a pressure fluctuation caused by the sub-streams, have a strong influence on not only fluctuation of a molten steel stream in the vicinities of the upper end of the inner bore but also a flow state (stability, turbulence, etc.) of a molten steel stream over the entire lower region of the inner bore.

Further, the inventors found out that the formation of the sub-streams flowing from the vicinity of the bottom surface of the tundish toward the upper end of the inner bore, and the phenomenon such as a pressure fluctuation, etc caused by the sub-streams, are strongly affected by the configuration of the inner bore, and flow straightening (stabilization of a molten steel stream, or prevention of turbulence in a molten steel stream) can be achieved by forming the inner bore into a specific configuration as described below.

The flow straightening of molten steel (stabilization of a molten steel stream, or prevention of turbulence in a molten steel stream) within the inner bore is determined by a distribution of pressures at respective positions in a flow direction (i.e., in an upward-downward direction) of molten steel within the inner bore. In other words, the flow straightening is determined by a state of change in energy loss in a molten steel stream at each position downwardly away from the upper end of the nozzle.

Fundamentally, energy for producing a flow speed of molten steel passing through the inner bore of the nozzle is based on a hydrostatic head (hydrostatic height) of molten steel within the tundish. Thus, a flow speed v (z) of molten steel at a position located a distance z downward from the upper end of the nozzle (the upper end of the inner bore) is expressed as the following formula (3):

$$v(z)=k(2g(Hm+z))^{1/2} \quad (3),$$

where: g is a gravitational acceleration; Hm is an actual hydrostatic head (actual hydrostatic height); and k is a flow coefficient.

A flow volume Q of molten steel passing through the inner bore of the nozzle is a product of the flow speed v and a cross-sectional area A of the inner bore. Thus, the flow volume Q is expressed as the following formula (4):

$$Q=v(L)\times A(L)=k(2g(Hm+L))^{1/2}\times A(L) \quad (4),$$

where: L is a length of the nozzle; v (L) is a flow speed of molten steel at a lower end of the nozzle (a lower end of the inner bore); and A (L) is a cross-sectional area of the inner bore at the lower end of the nozzle.

The flow volume Q is constant in a cross section taken along a plane perpendicular to an axis of the inner bore at any position within the inner bore. Thus, a cross-sectional area A (z) at a position located the distance z downward from the upper end of the nozzle (the upper end of the inner bore) is expressed as the following formula (5):

$$A(z)=Q/v(z)=k(2g(Hm+L))^{1/2}\times A(L)/k(2g(Hm+z))^{1/2} \quad (5)$$

Then, the following formula (6) is obtained by dividing each of the right-hand and left-hand sides of the formula (5) by A (L):

$$A(z)/A(L)=((Hm+L)/(Hm+z))^{1/2} \quad (6)$$

A (z) and A (L) are expressed as follows: $A(z)=\pi r(z)^2$, and $A(L)=\pi r(L)^2$, where π is a ratio of the circumference of a circle to its diameter. Thus, the formula (6) is transformed as follows:

$$A(z)/A(L)=\pi r(z)^2/\pi r(L)^2=((Hm+L)/(Hm+z))^{1/2} \quad (7)$$

$$r(z)/r(L)=((Hm+L)/(Hm+z))^{1/4} \quad (8)$$

Thus, the radius r (z) of the inner bore at a position located the distance z is expressed as the following formula (9):

$$\log(r(z))=(1/4)\times\log((Hm+L)/(Hm+z))+\log(r(L)) \quad (9)$$

The energy loss can be minimized by forming a wall surface of the inner bore into a cross-sectional shape satisfying the formula (9).

According to the formula (9), a quartic curve will be plotted on a graph. When the wall surface of the inner bore is formed in a shape corresponding to the graph according to the formula (9), a pressure loss of molten steel can also be minimized In addition, in the shape satisfying the formula (9), a pressure of the molten steel is gradually (gently) reduced as a position located the distance z downward from the upper end of the nozzle (the upper end of the inner bore) becomes lower, so that a flow-straightened state is established.

The above formula for calculating the pressure distribution using the Hm is set up on an assumption that molten steel flows into the upper end of the inner bore uniformly and directly in an approximately vertical direction according to a hydrostatic head pressure of a molten steel surface in the tundish.

However, in actual casting operations, a molten steel stream is formed to flow multidirectionally from the vicinity of the bottom surface of the tundish adjacent to the upper end of the nozzle serving as the inlet of the molten steel discharge passage, toward the inner bore, as described above. Thus, as a prerequisite to accurately figuring out a real pressure distribution in the inner bore, it is necessary to use a hydrostatic head having a large influence on a flow of molten steel from the vicinity of the bottom surface of the tundish adjacent to the upper end of the nozzle, in place of the Hm.

Therefore, the inventers carried out studies based on various simulations. As a result, the inventers found out that it is effective to use a value of the Hm to be obtained by setting the distance z to zero in the formula (9), as a hydrostatic head (hydrostatic height) Hc for the calculation, i.e., calculative hydrostatic head Hc (hereinafter referred to simply as "Hc", on a case-by-case basis).

Specifically, the Hc can be expressed by the following formula (10):

$$Hc=((r(L)/r(0))^4\times L)/(1(r(L)/r(0))^4) \quad (10)$$

As seen in the formula (10), the Hc is defined by a ratio of the radius r(L) of the inner bore at the lower end of the nozzle to the radius r(0) of the inner bore at the upper end of the nozzle, and the length L of the nozzle. This calculative hydrostatic head Hc has an influence on a pressure of molten steel within the inner bore of the nozzle of the present invention. In other words, a cross-sectional shape of the wall surface of the inner bore using the Hc in place of the Hm in the formula (9) makes it possible to suppress a rapid or sharp pressure change which would otherwise occur adjacent to the upper end of the inner bore.

The formula (10) can be transformed into the following formula (11) to express a ratio of the r(0) to the r(L), instead of the Hc:

$$r(0)/r(L)=((Hc+L)/(Hc+0))^{1/4} \quad (11)$$

The Hc is illustrated in FIG. 1 which is a schematic axial sectional view showing a molten steel vessel (tundish) and a nozzle (continuous casting nozzle). In FIG. 1, a nozzle 1 has an inner bore 4 for allowing passage of molten steel. The reference numeral 5 indicates the largest-diameter portion of the inner bore (having a radius r(0)) at an upper end 2 of the nozzle, and the reference numeral 6 indicates the smallest-diameter portion of the inner bore (having a radius r(L)) at a lower end 3 of the nozzle. The inner bore has a wall surface 7 extending from the largest-diameter portion 5 to the smallest-diameter portion 6. The upper end 2 of the nozzle is an origin (zero point) of the aforementioned distance z.

As above, the cross-sectional shape of the wall surface of the inner bore using the Hc in place of the Hm in the formula (9) makes it possible to continuously and gradually reduce a pressure distribution at a center of the inner bore of the nozzle with respect to a heightwise direction so as to stabilize a molten steel stream and produce a smooth (constant) molten steel stream with less energy loss. Further, the inventers conducted a fluid analysis based on a computer simulation as a means to evaluate stability and smoothness of the molten steel stream. As a result, the inventers found out that it is effective to obtain a pressure of molten steel at the center of the inner bore in horizontal cross-section at a position located the distance z downward from the upper end of the nozzle (the upper end of the inner bore).

This simulation was performed using fluid analysis software (trade name "Fluent Ver. 6.3.26 produced by Fluent Inc.). Input parameters in the fluid analysis software are as follows:

The number of calculative cells: about 120,000 (wherein the number can vary depending on a model)

Fluid: water (wherein it has been verified that the evaluation for molten steel can also be performed in a comparative manner)
density=998.2 kg/m$^3$
viscosity=0.001003 kg/m·s Hydrostatic Head (Hm): 600 mm Pressure: inlet (molten steel surface)=((700+a length (mm) of a nozzle)×9.8) Pa (gage pressure)
outlet (lower end of the nozzle)=zero Pa Length of Nozzle: 120 mm, 230 mm, 800 mm (see Table 1)

Viscous Model: K-omega calculation

As a result of detail fluid analyses, the inventors found out that, in a graph where the distance z downward from the upper end of the nozzle (the upper end of the inner bore) is plotted with respect to a horizontal axis (X-axis) thereof, and a pressure of molten metal at the center of the inner bore in horizontal cross-section at a position located the distance z is plotted with respect to a vertical axis (Y-axis) thereof (this graph will hereinafter be referred to as "z-pressure graph"), a shape of a line on the z-pressure graph has a critical influence on stability (prevention of turbulence) of a molten steel stream, required for achieving the object of the present invention.

Specifically, the nozzle of the present invention is characterized in that it is configured to eliminate a region causing a sharp change in the pressure in the z-pressure graph so as to allow the pressure to be gently reduced along with an increase in the distance z (if there is a region causing a sharp change in the pressure with respect to an increase in the distance z, the region triggers the occurrence of turbulence in a molten metal stream flowing downwardly therefrom).

In other words, the nozzle of the present invention is configured such that a line plotted on the z-pressure graph has an approximately straight shape (see, for example, FIG. 6(*a*)) or a gentle arc-like curved shape (see, for example, FIG. 6(*b*)). It means that the line does not have a region where a sharp change in curvature or direction occurs as in a line having a shape similar to an alphabetical character "S", "C", "L" or the like (see, for example, FIGS. 6(*c*), 7A, 7B, 7C and 7D).

More specifically, in cases where a line plotted according to an approximation formula has a region where a sharp change in direction or curvature occurs, the line includes a plurality of linear regression lines (an absolute value of a correlation coefficient is 0.95 or more) or a plurality of nonlinear curves (nonlinear curved lines). In an evaluation, for the present invention, of such curves in terms of a coefficient of a regression line, a plurality of approximation curves are derived when a nonlinear regression is applied to a region extending from the upper end of the nozzle (i.e., z=0) to a position located a certain distance downward from the upper end of the nozzle, wherein coefficients (the invariables) of the curves with respect to the X-axis value do not have opposite (positive/negative) signs in the same curve (For example as an undesirable case, the curve in FIG. 6(*c*) plotting a relationship between the distance z and the pressure includes three nonlinear approximation curves A, B, C in respective regions defined by approximately equally dividing the distance z into three parts, wherein an approximation formula of the curves A and B or the curve B and C includes two coefficients having opposite (positive/negative) signs). Thus, it is necessary that a line itself on the z-pressure graph does not simultaneously include coefficients of opposite (positive/negative) signs, with respect to the X-axis value.

In view of obtaining the most stable molten steel stream, it is necessary that a line on the z-pressure graph has a certain level of linearity, preferably, a shape infinitely close to a straight line. As a criterion for evaluation on linearity of a line, an absolute value of a correlation coefficient of the line is required to be 0.95 or more, on an assumption that the line is derived from an approximation formula based on a linear regression. If a nozzle has a region causing a sharp change in molten steel pressure within an inner hole, the absolute value of the correlation coefficient on the assumption that the line on the z-pressure graph is derived from an approximation formula based on a linear regression, becomes smaller. If the absolute value is less than 0.95, turbulence will occur in a molten steel stream to such an extent that it causes difficulty in achieving the object of the present invention.

The above value was determined from results obtained by a simulation using the aforementioned Fluent, and an experimental test, such as a test in an actual casting operation.

Further, based on the results of the simulation and others, the inventors found out that the flow straightening can be achieved even if the degree "4" in the formulas (9) and (10) is set in the range of 1.5 to 6 to determine the curved line. Thus, by replacing the degree with "n", the formula (9) and formula (10) can be expressed as the following formula (1) and formula (2), respectively:

$$\log(r(z))=(1/n)\times\log((Hc+L)/(Hc+z))+\log(r(L)) \quad (1),$$

where $6 \geqq n \geqq 1.5$ $$Hc=((r(L)/r(0)r\times L)/(1-(r(L)/r(0))^n) \quad (2),$$

where $6 \geqq n \geqq 1.5$

If a value of n is less than 1.5 or greater than 6, a sharp change will occur in a line on the z-pressure graph (see the after-mentioned Example).

A wall surface of an inner bore of a nozzle based on the formulas (1) and (2) has a configuration as schematically illustrated in FIGS. 3(*a*) and 3(*b*). FIGS. 3(*a*) and 3(*b*) show an upper nozzle 1*a*, wherein FIG. 3(*a*) is a vertical sectional view, and FIG. 3(*b*) is a cubic diagram. In FIGS. 3(*a*) and 3(*b*), the reference numeral 10 indicates a configuration of the wall surface of the inner bore when n=1.5, and the reference numeral 11 indicates a configuration of the wall surface of the inner bore when n=6.

Preferably, the configuration of the wall surface of the inner bore of the nozzle of the present invention based on the formulas (1) and (2), wherein a line on the z-pressure graph meets the given requirements (the line is a gentle curved line, and an absolute value of a correlation coefficient of a linear regression line is 0.95 or more), is formed over the entire length of the inner bore. Alternatively, the configuration may be formed in at least a part of the wall surface extending downwardly from the upper end of the inner bore. Based on the after-mentioned Example, it was verified that, even if the nozzle (molten steel passage) has an extension portion additionally extending downwardly from a portion having the above configuration, stability of a molten steel stream flow-straightened by the configuration according to the present invention is maintained with the flow-straightening effect intact (see Example B).

Effect of the Invention

In a nozzle for discharging molten metal from a molten metal vessel, a flow of the molten metal within an inner bore of the nozzle can be stabilized without turbulence. This makes it possible to suppress the occurrence of inclusion adhesion on a wall surface of the inner bore, local wear of the wall surface of the inner bore, etc., so as to allow an operation of discharging molten metal in a stable flow state to be maintained for a long period of time. In addition, it becomes possible to suppress scattering of molten metal discharged from a lower end of an open nozzle.

Further, the nozzle of the present invention can be obtained only by forming the wall surface of the inner bore in an adequate configuration, without a need for providing a particular mechanism such as a gas injection mechanism, so that the nozzle can be easily produced with a simple structure to facilitate a reduction in cost.

BRIEF DESCRIPTION OF DRAWINGS

FIG. 9 is Table 1 showing conditions and results of the simulation in Example A.

FIG. 10 is Table 2 showing conditions and results of the simulation in Example B.

DESCRIPTION OF EMBODIMENTS

An embodiment of the present invention will now be described with Examples based on a simulation result, and an analysis result in an actual casting operation.

EXAMPLES

Example A

Figure 5:
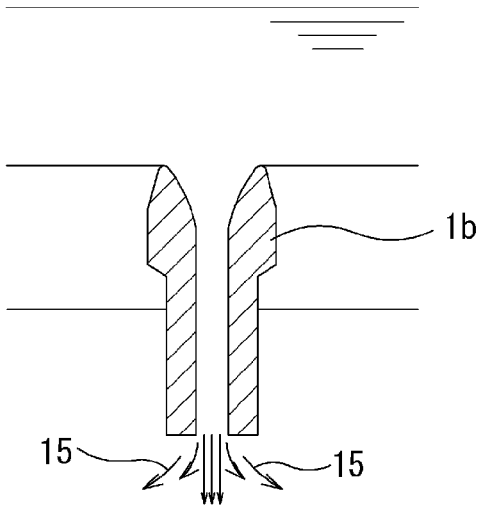
FIG. 5 is a schematic axial sectional view showing an open nozzle.
Figure 6:
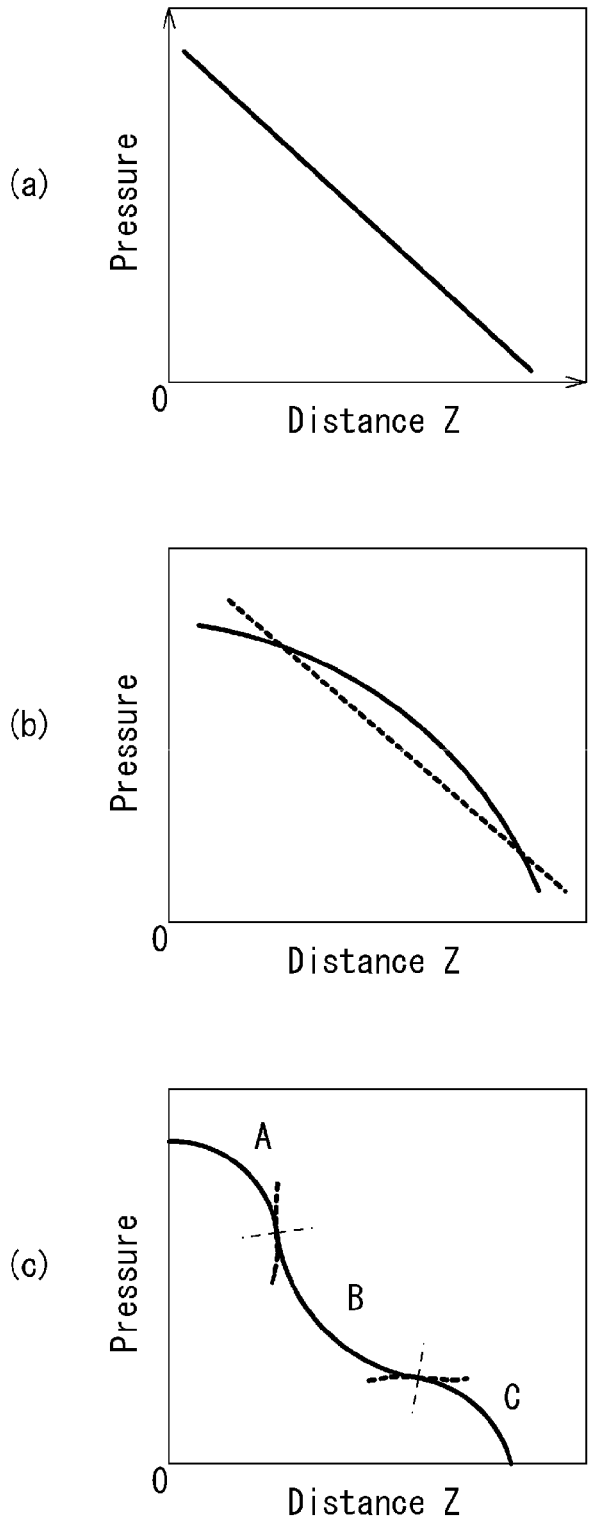
FIGS. 6(*a*) to 6(*c*) schematically illustrate a line on a z-pressure graph, wherein FIGS. 6(*a*), 6(*b*) and 6(*c*) show an example of a straight line, an example of a gentle arc-like curved line, and an example of a line including a plurality of (in the illustrated example, three) approximation curves having different (positive/negative) coefficients, respectively.

Example A is a simulation result of an open nozzle (see FIG. 5) having no flow-volume control device in a flow passage thereof, as one example of a nozzle for discharging molten steel from a tundish into a mold below the tundish. Table 1 (FIG. 9) shows conditions and results.

This simulation was performed using the aforementioned fluid analysis software (trade name "Fluent Ver. 6.3.26 produced by Fluent Inc.). Input parameters in the fluid analysis software are as described above.

FIGS. 7A to 7M show z-pressure graphs obtained by the simulation for each of the samples in Table 1. More specifically, in each of FIGS. 7A to 7M, a distance z downward from an upper end of a nozzle (an upper end of an inner bore) is plotted with respect to a horizontal axis (X-axis) thereof, and a pressure of molten steel at a center of the inner bore in horizontal cross-section at a position located the distance z is plotted with respect to a vertical axis (Y-axis) thereof, based on the simulation result on each sample in Table 1. The pressure is a relative value, and thereby an absolute value thereof slides up and down depending on conditions.

Each of the samples 1 to 8 is a nozzle according to the present invention, i.e., a nozzle prepared using the formulas 1 and 2. Among them, the inventive samples 1, 2, 5 and 6 were prepared by changing n in the formula 1 to check an influence of n. When n is set to 1.5 (the inventive sample 1: FIG. 7E) and 2 (the inventive sample 2: FIG. 7F), a line on the z-pressure graph is plotted as a gentle arc line, and no inflection region is observed. Further, as n is increased from 1.5 to 2, a curvature of the arc becomes gentler, and the line comes closer to a straight line. In addition, there is no inflection region in each of the arc lines.

Figure 7A:
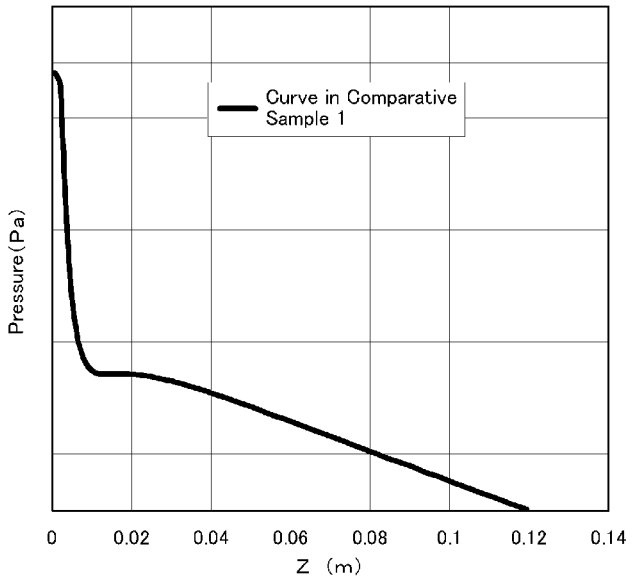
FIG. 7A is a z-pressure graph in a comparative sample 1.
Figure 7B:
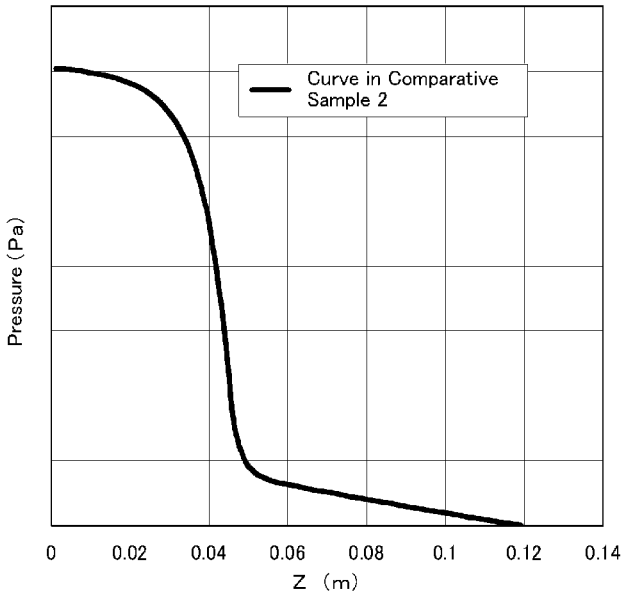
FIG. 7B is a z-pressure graph in a comparative sample 2.
Figure 7C:
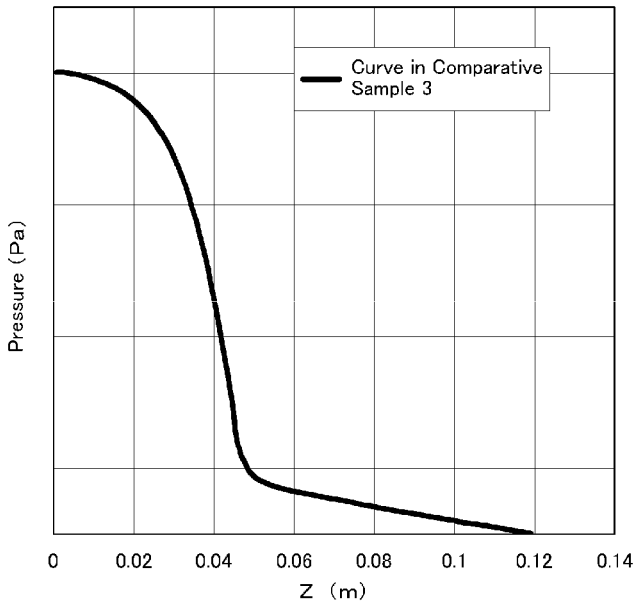
FIG. 7C is a z-pressure graph in a comparative sample 3.
Figure 7D:
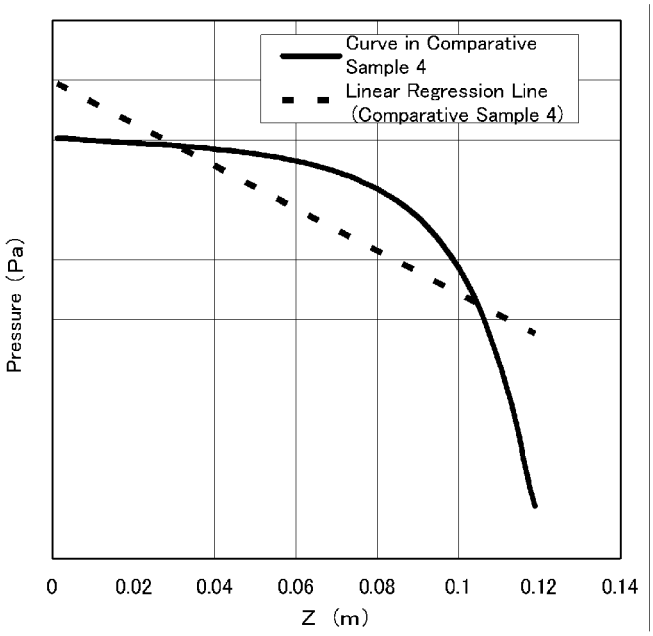
FIG. 7D is a z-pressure graph in a comparative sample 4.
Figure 7E:
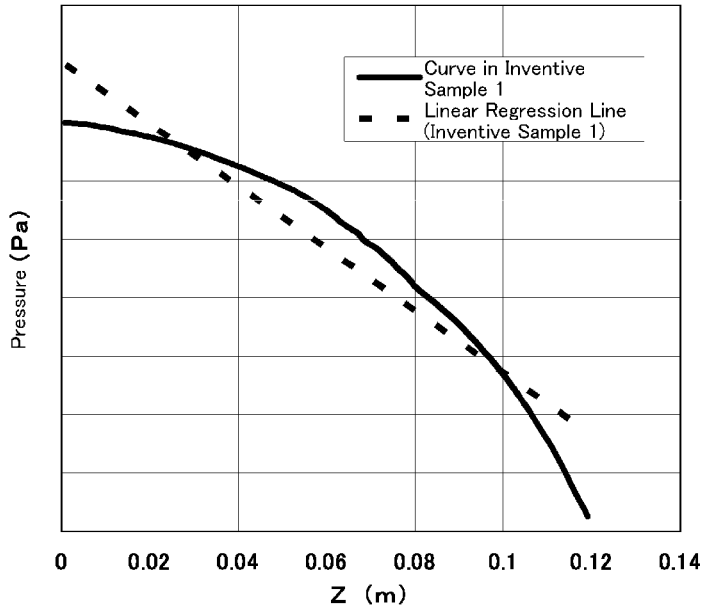
FIG. 7E is a z-pressure graph in an inventive sample 1.
Figure 7F:
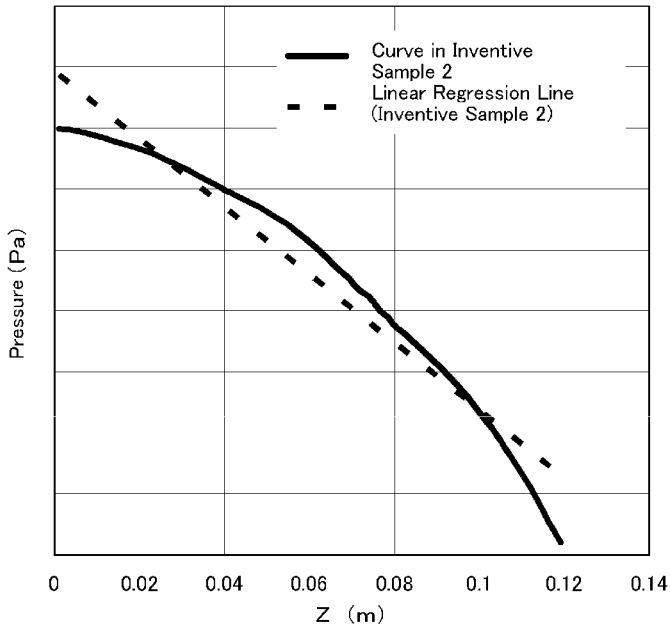
FIG. 7F is a z-pressure graph in an inventive sample 2.
Figure 7G:
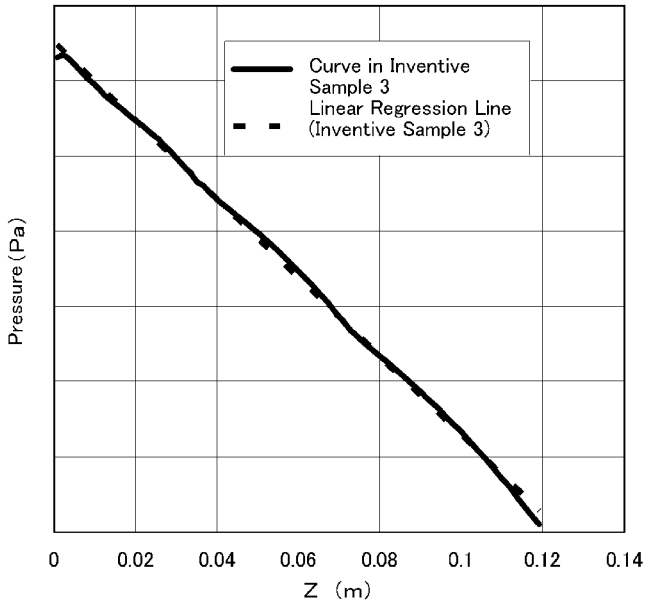
FIG. 7G is a z-pressure graph in an inventive sample 3.
Figure 7H:
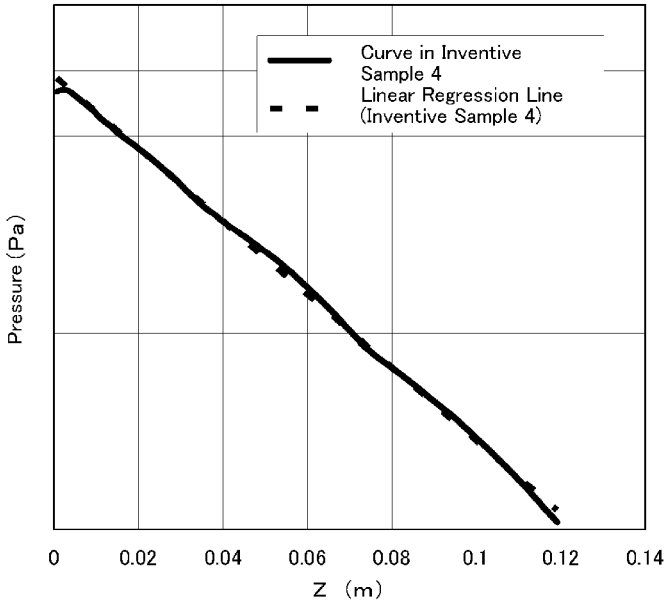
FIG. 7H is a z-pressure graph in an inventive sample 4.
Figure 7I:
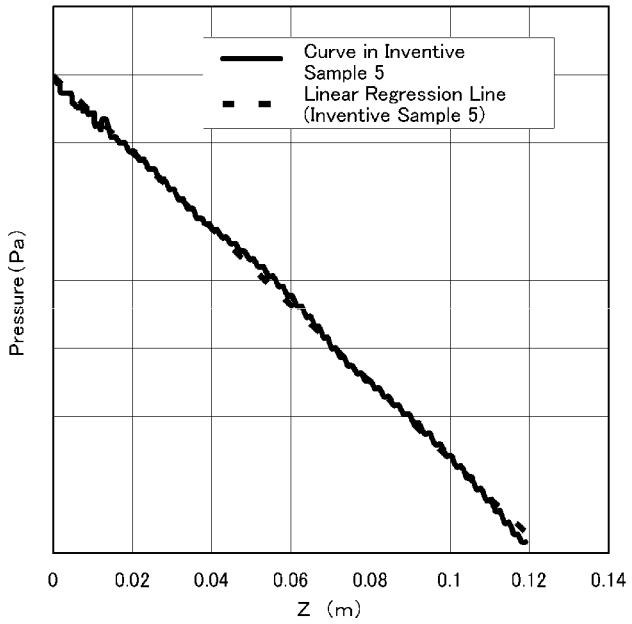
FIG. 7I is a z-pressure graph in an inventive sample 5.
Figure 7J:
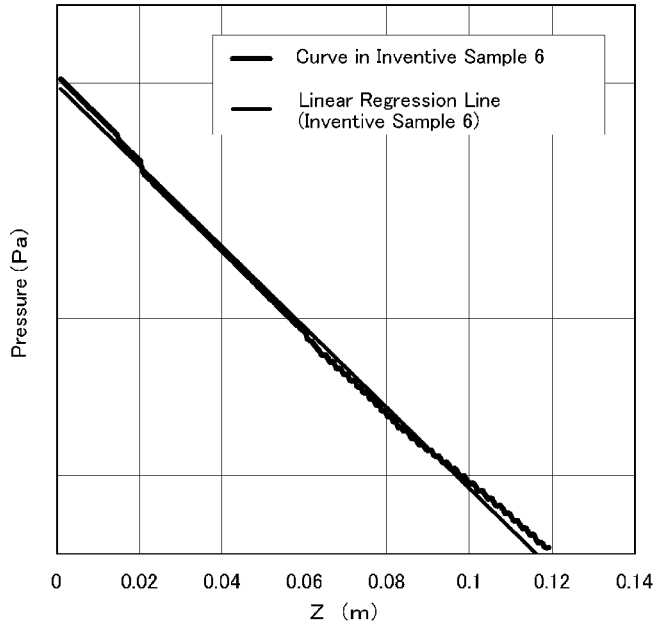
FIG. 7J is a z-pressure graph in an inventive sample 6.

As seen in FIGS. 7I and 7J, when n is set to 4 (the inventive sample 5: FIG. 7I) and 6 (the inventive sample 6: FIG. 7J), a line on the z-pressure graph has an approximately straight shape. Further, when a correlation coefficient is checked on an assumption that each of the lines is derived from an approximation formula based on a linear regression, the correlation coefficient is increased from −0.95, −0.97 to −0.99, −0.99, along with an increase in n, i.e., strong correlativity is observed.

As above, the line on the z-pressure graph has no inflection region, and the pressure is gradually increased along with an increase in the distance z. This shows that a stable flow state is obtained without turbulence over the entire flow passage of the inner bore.

Each of the inventive samples 3, 4 and 5 was used to check an influence of a ratio r(L)/r (0), i.e., a ratio of a radius of the inner bore at the upper end of the nozzle to a radius of the inner bore at a lower end of the nozzle, on a flow state (a line on the z-pressure graph), when n=4. In these samples, each line on the z-pressure graphs (FIGS. 7G to 7I) has an approximately straight shape without an inflection region, and a correlation coefficient is −0.99. Thus, no influence of the ratio r(L)/r (0) is observed.

Each of the inventive samples 7 and 8 was used to check an influence of the radius r(L), the radius r(0) and the nozzle length L, when each of the radius r(L) and the radius r(0) is greater than that of the inventive samples 1 to 6, and the nozzle length L is extended about 7 times downwardly. In this case, n was set to 4, and the ratio r(L)/r (0) was set to 2 and 2,5, which correspond to the conditions for the inventive samples 3 and 4. As seen from the z-pressure graphs (FIGS. 7L and 7M), each of the ratio r(L)/r (0) and the nozzle length L has no influence on the flow state.

In the above inventive samples, each line on the z-pressure graphs has an approximately straight shape without an inflection region, and a correlation coefficient is about −0.95 or more. Thus, no influence of the ratio r(L)/r (0) and the nozzle length L is observed. This shows that, if there is no inflection region in a line on the z-pressure graph, and an absolute value of a correlation coefficient in an approximation formula for a linear regression of the line is 0.95 or more, a stable flow state of molten steel without turbulence can be maintained even if the nozzle length is extended downwardly.

Differently from the above inventive samples, each of the comparative samples 4 and 5 is a nozzle where n is not in the range defined in the present invention.

In the comparative sample 4 where n=1.0, as shown in FIG. 7D, a line on the z-pressure graph is a curved line similar to two straight lines which have largely different inclinations and crosses at about right angle, although it has no S-shaped inflection region. Thus, in this case, turbulence is highly likely to undesirably occur in a molten steel stream downwardly from a position corresponding to a vicinity of the crossing region, due to a slight fluctuation in casting conditions.

Figure 7K:
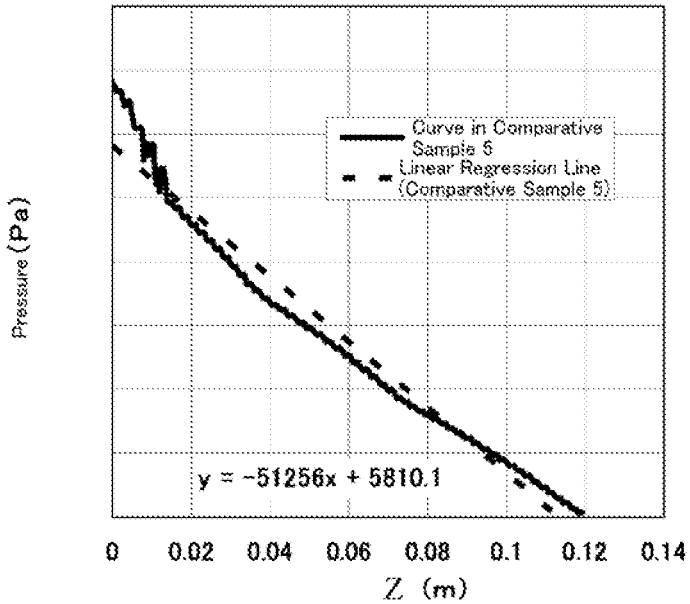
FIG. 7K is a z-pressure graph in a comparative sample 5.
Figure 7L:
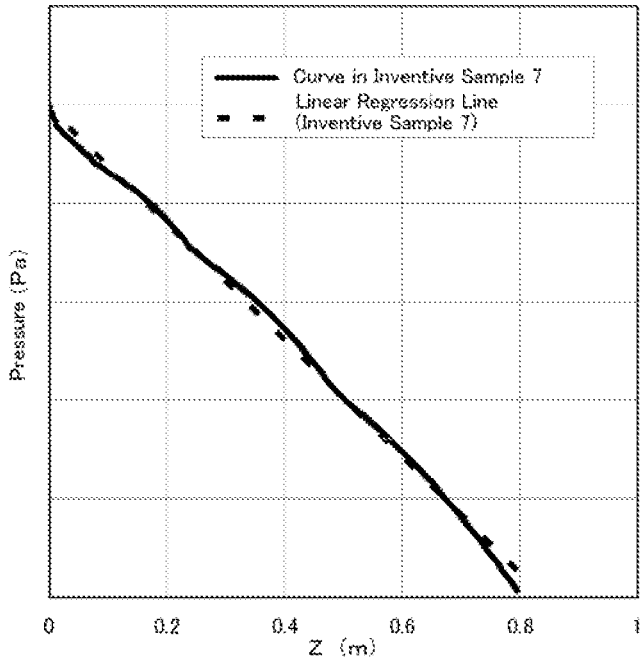
FIG. 7L is a z-pressure graph in an inventive sample 7.
Figure 7M:
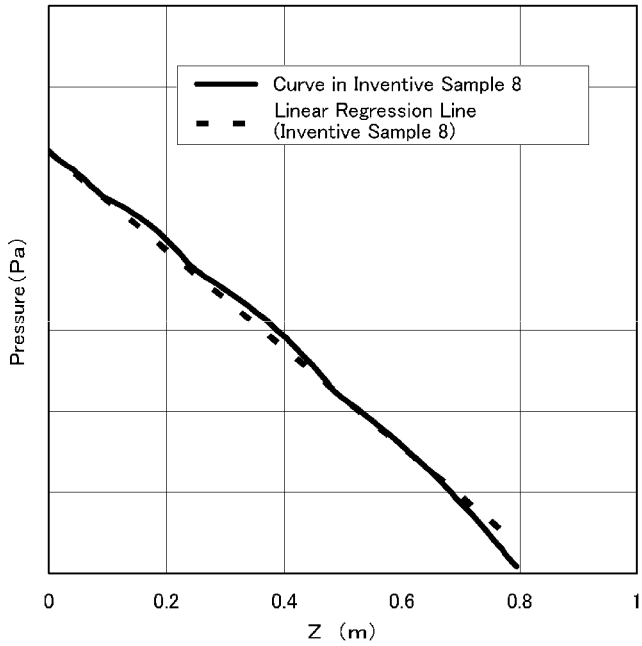
FIG. 7M is a z-pressure graph in an inventive sample 8.

In the comparative sample 5 where n=7.0, as shown in FIG. 7K, an S-shaped inflection region is observed in a line on the z-pressure graph, although it is not significantly large. This means that respective coefficients of an approximation curve in a vicinity of each of the upper and lower ends of the inner bore and an approximation curve in an intermediate portion of the inner bore have opposite (positive/negative) signs, so that turbulence is highly likely to undesirably occur in a molten steel stream from a position corresponding to a vicinity of a boundary therebetween. Therefore, n is required to be in the range of 1.5 to 6.

The comparative sample 1 is a nozzle having an inner bore formed in a straight configuration extending from the upper end to the lower end thereof, i.e., a cylindrical configuration. The comparative sample 2 is a nozzle having an inner bore formed in a taper configuration, and the comparative sample 3 is a nozzle having an inner bore formed in an arc configuration with R=47. In each of these comparative samples, a line on the z-pressure graph (FIGS. 7A to 7C) has a significant S-shaped inflection region, turbulence in a molten steel stream will occur from a position corresponding to a vicinity of the inflection region.

A test piece was prepared for each of the samples in Example A, and a discharge state of water from a water tank having a depth of about 600 mm was visually observed. As a result, scattering in each of the inventive samples was small or at a level incapable of being visually observed, whereas, in each of the comparative samples, scattering occurred at a level capable of being constantly or intermittently visually observed (see the reference number 15 in FIG. 5).

Example B

Figure 1:
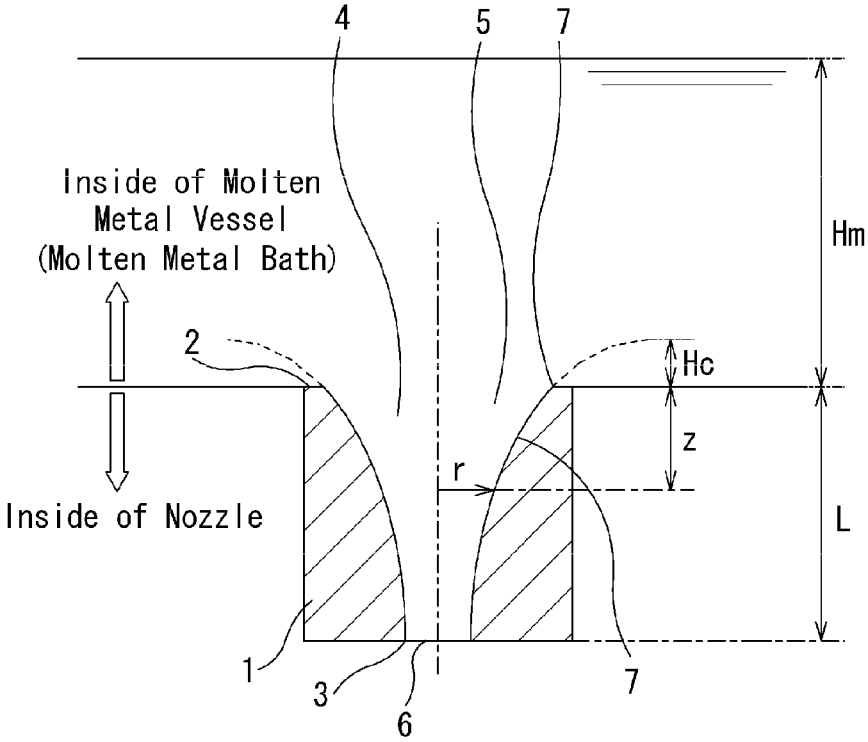
FIG. 1 is a schematic axial sectional view showing a molten steel vessel (tundish) and a nozzle (continuous casting nozzle).
Figure 2:
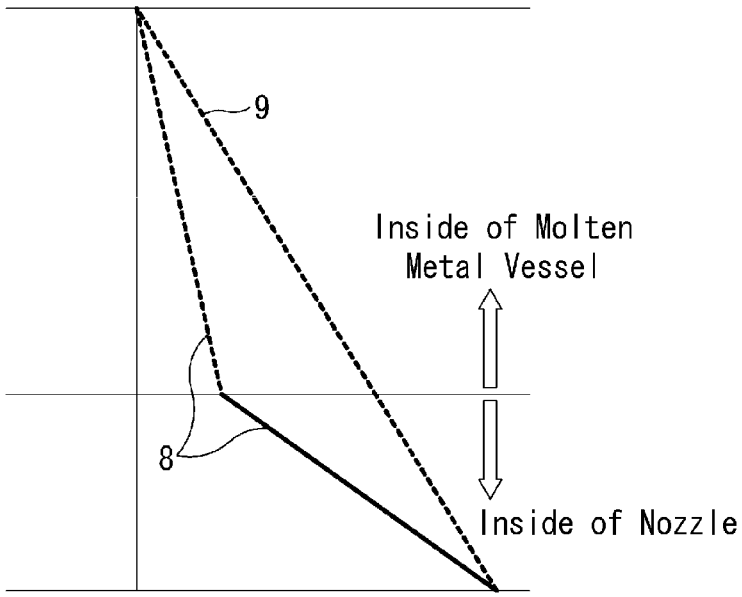
FIG. 2 is a graph schematically showing a pressure distribution of molten metal within the molten metal vessel and the nozzle.
Figure 3:
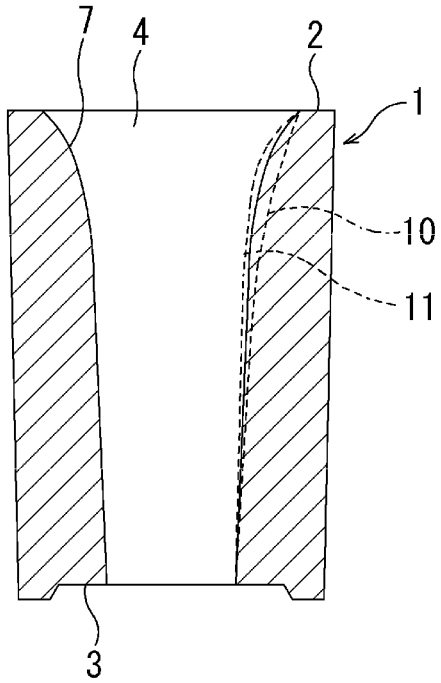
FIGS. 3(*a*) and 3(*b*) schematically illustrate a configuration of a wall surface of an inner bore of a nozzle of the present invention, wherein FIG. 3(*a*) is a vertical sectional view, and FIG. 3(*b*) is a cubic diagram.
Figure 3:
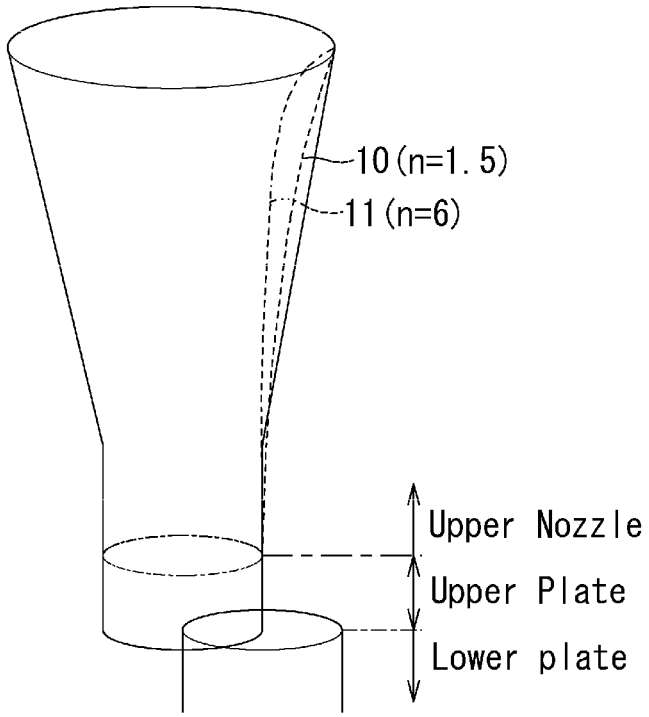
Figure 4:
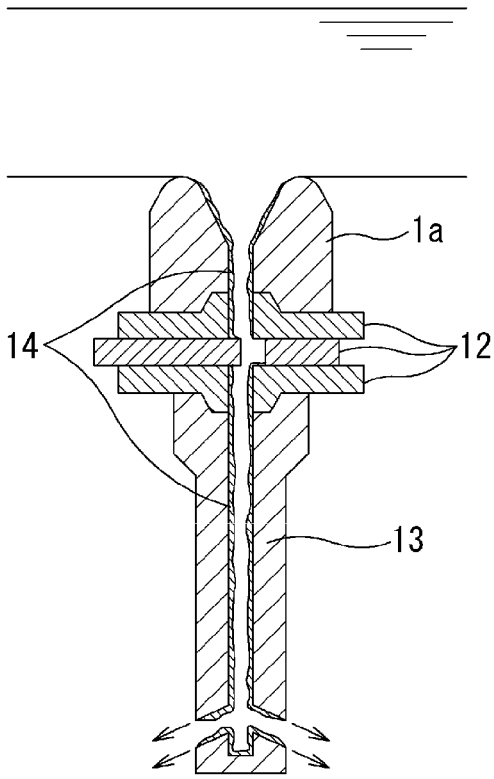
FIG. 4 is a schematic axial sectional view showing an upper nozzle (in an example where a sliding nozzle is provided therebeneath, wherein an intermediate nozzle or a lower nozzle may be provided between the sliding nozzle and an immersion nozzle beneath the sliding nozzle).

Example B is a simulation result and a result of a verification test in an actual casting operation, of a so-called SN upper nozzle having a flow-volume control device (sliding nozzle (SN) device) in a flow passage thereof, as one example of the nozzle for discharging molten steel from a tundish into a mold below the tundish. In this case, a molten steel flow passage is formed in an upper nozzle (see 1*a* in FIG. 4), a sliding nozzle device (see 12 in FIG. 4), a lower nozzle (although not illustrated in FIG. 4, it is located between the sliding nozzle device 12 and an after-mentioned immersion nozzle 13), and immersion nozzle (see the reference numeral 13 in FIG. 4), in this order downwardly from a tundish. In cases where the lower nozzle and the immersion nozzle is integrated together (as shown in FIG. 4), conditions may be considered to be the same as those for Example B.

Table 2 (FIG. 10) shows conditions and results. In the simulation in Example B, a degree of open area or opening in the flow-volume control device is set to 50%. The remaining conditions were the same as those for Example A.

FIGS. 8A to 8D show z-pressure graphs obtained by the simulation for each of the samples in Table 2. More specifically, in each of FIGS. 8A to 8D, a distance z downward from an upper end of a nozzle (an upper end of an inner bore) is plotted with respect to a horizontal axis (X-axis) thereof, and a pressure of molten steel at a center of the inner bore in horizontal cross-section at a position located the distance z is plotted with respect to a vertical axis (Y-axis) thereof, based on the simulation result on each sample in Table 2. The pressure is a relative value, and thereby an absolute value thereof slides up and down depending on conditions.

Each of the samples 9 and 10 is a nozzle according to the present invention, i.e., a nozzle prepared using the formulas 1 and 2. In these inventive samples, each line of the z-pressure graphs (FIGS. 8C and 8D) has an approximately straight shape without an inflection region, and an absolute value of a correlation coefficient of a linear regression line is 0.99.

Figure 8A:
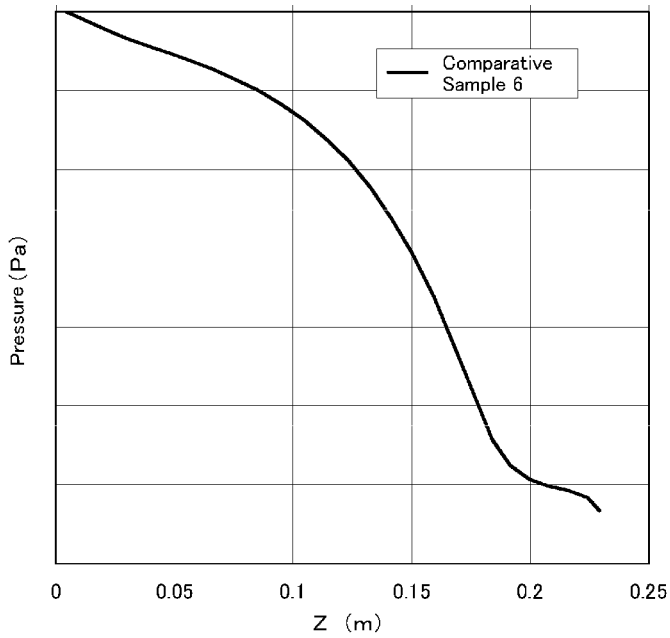
FIG. 8A is a z-pressure graph in a comparative sample 6.
Figure 8B:
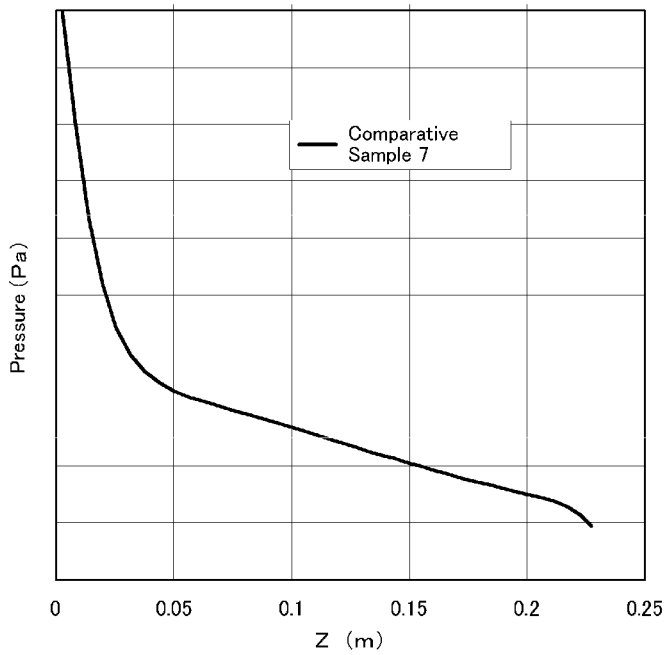
FIG. 8B is a z-pressure graph in a comparative sample 7.
Figure 8C:
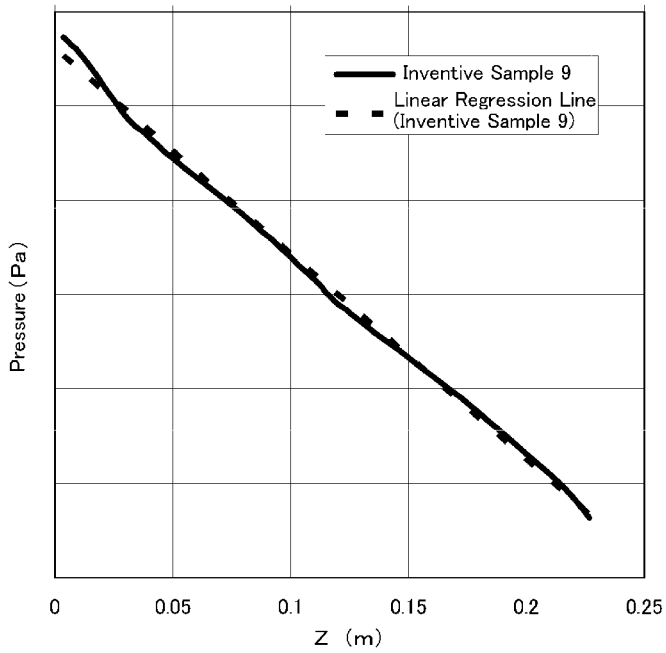
FIG. 8C is a z-pressure graph in an inventive sample 9.
Figure 8D:
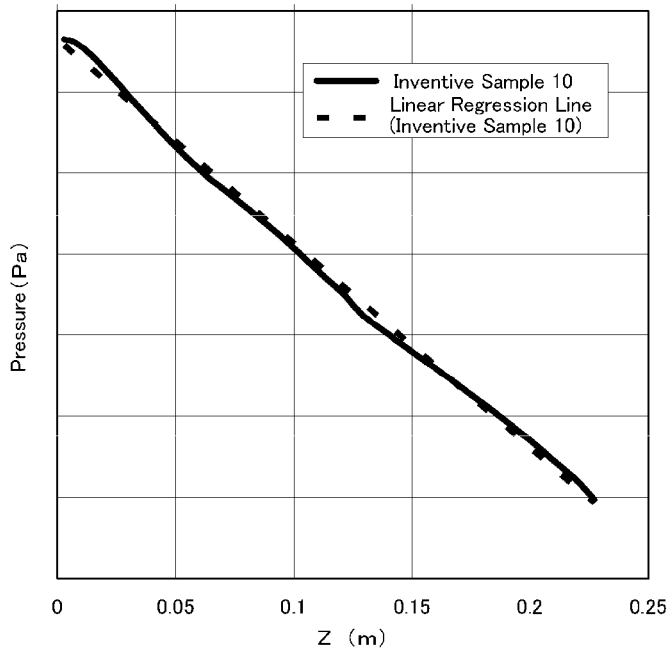
FIG. 8D is a z-pressure graph in an inventive sample 10.

The comparative sample 7 is a nozzle having an inner bore formed in a configuration close to a circular column, where the ratio r(L)/r (0) is 1.1, although a wall surface of the inner bore is set based on the formulas 1 and 2 as with the inventive samples 9 and 10. In the comparative sample 7, as shown in FIG. 8B, an inflection region is observed in a line on the z-pressure graph, which shows an existence of turbulence in a molten steel stream. This shows that a nozzle meeting only the requirements of the formulas 1 and 2 is likely to have difficulty in suppressing turbulence in a molten steel stream, and therefore it is necessary to determine a specific configuration of the wall surface of the inner bore, while taking into account a shape of a line on the z-pressure graph.

The comparative sample 6 is a conventional nozzle where a wall surface of an inner bore thereof has a taper configuration. In this sample, a line on the z-pressure graph has an S-shaped inflection region as shown in FIG. 8A, and turbulence in a molten steel stream will occur from a position corresponding to a vicinity of the inflection region.

The nozzle of the inventive sample 10 was applied to an actual casting operation in place of the nozzle of the comparative sample 6 which has been used therein. Conditions of the casting operation were set as follows: an actual hydraulic head (height of molten steel) in a tundish=about 800 mm; a discharge rate of molten steel=about 1 to 2 t/min; and a casting (steel discharge) time: about 60 minutes.

As a test result in the actual casting operation, in the inventive sample 10, a significantly stable casting state (having a small number of adjustments for the degree of opening) could be maintained without any inclusion adhesion and local wear in the entire region of an inner wall of the upper nozzle to the lower-side immersion nozzle. This shows that stability of a molten steel stream flow-straightened by the inner bore having the configuration according to the present invention is maintained with the flow-straitening effect intact, even if the nozzle (molten steel flow passage) has an extension portion additionally extending downwardly from the inner bore having the configuration.

Differently from the inventive sample, in the comparative sample 6, an alumina-based adhesion layer having an average thickness of 20 mm (see the reference number 14 in FIG. 4) was formed over a wide range of an inner wall of the upper nozzle to the lower-side immersion nozzle, to cause an unstable casting state (having a large number of adjustments for the degree of opening).

EXPLANATION OF CODES

1: nozzle
1*a*: open nozzle
1*b*: upper nozzle
2: upper end of nozzle
3: lower end of nozzle
4: inner bore
5: largest-diameter portion of inner bore
6: smallest-diameter portion of inner bore
7: wall surface of inner bore
8: (schematic) molten-steel pressure distribution curve in region between actual molten steel vessel and inside of nozzle
9. (schematic) ideal molten-steel pressure distribution curve in region from molten steel vessel to inside of nozzle
10: configuration of wall surface of inner bore when n=1.5
11: configuration of wall surface of inner bore when n=6
12: flow-volume control device (sliding nozzle device)
13: immersion nozzle
14: (schematic) state of adhered layer
15: (schematic) state of scattering of molten steel

What is claimed is:

1. A molten metal discharge nozzle formed with an inner bore for allowing passage of molten metal and designed to be installed to a bottom of a molten metal vessel so as to discharge molten metal from the molten metal vessel through the inner bore, wherein a cross-sectional shape of a wall surface of the inner bore, taken along an axis of the inner bore, comprises a part or an entirety of a curved line expressed by the following formula (1):

$$\log(r(z))=(1/n)\times\log((Hc+L)/(Hc+z))+\log(r(L)) \quad (1),$$

where: $6 \geqq n \geqq 1.5$; L is a length of the nozzle; Hc is a calculative hydrostatic head; and r(z) is a radius of the inner bore at a position located a distance z downward from an upper end of the nozzle, the calculative hydrostatic head Hc being expressed by the following formula (2):

$$Hc=((r(L)/r(0))^n\times L)/(1-(r(L)/r(0))^n) \quad (2),$$

where: $6 \geqq n \geqq 1.5$; r(0) is a radius of the inner bore at the upper end of the nozzle; and r(L) is a radius of the inner bore at a lower end of the nozzle, and wherein, in a graph where the distance z is plotted with respect to a horizontal axis (X-axis) thereof, and a pressure of molten metal at a center of the inner bore in horizontal cross-section at a position located the distance z is plotted with respect to a vertical axis (Y-axis) thereof, an approximation formula of a line on the graph is established without simultaneously including two or more coefficients having opposite signs, and wherein, on an assumption that the line is derived from an approximation formula based on a linear regression, an absolute value of a correlation coefficient of the line is 0.95 or more.

* * * * *